United States Patent [19]

Ambrosi

[11] Patent Number: 5,056,104

[45] Date of Patent: Oct. 8, 1991

[54] APPARATUS FOR ADJUSTING THE POSITION OF AN ELECTRODE IN A METAL SMELTING FURNACE

[75] Inventor: Luciano Ambrosi, Moers, Fed. Rep. of Germany

[73] Assignee: Mannesmann AG, Düsseldorf, Fed. Rep. of Germany

[21] Appl. No.: 541,615

[22] Filed: Jun. 21, 1990

[30] Foreign Application Priority Data

Jun. 26, 1989 [DE] Fed. Rep. of Germany ..... 3921238

[51] Int. Cl.[5] ..... H05B 7/10

[52] U.S. Cl. ..... 373/100; 373/94; 373/95

[58] Field of Search ..... 373/94, 95, 100, 101

[56] References Cited

U.S. PATENT DOCUMENTS

| | | | |
|---|---|---|---|
| 2,673,227 | 3/1954 | Hubert | 373/100 |
| 2,778,865 | 1/1957 | Kongsgaarden | 373/100 |
| 2,884,475 | 4/1959 | Foyn | 373/94 |
| 2,921,108 | 1/1960 | Meffert | 373/95 |
| 3,898,364 | 8/1975 | Hardin | 373/100 |
| 3,950,601 | 4/1976 | Popov et al. | 373/86 |
| 4,154,974 | 5/1979 | Wynne | 373/100 |
| 4,238,634 | 12/1980 | Krogsrud | 373/95 |
| 4,453,254 | 6/1984 | Ehle et al. | 373/93 |
| 4,495,624 | 1/1985 | Reimpell et al. | 373/92 |
| 4,617,672 | 10/1986 | Enkner et al. | 373/79 |

*Primary Examiner*—Bruce A. Reynolds
*Assistant Examiner*—Tu Hoang
*Attorney, Agent, or Firm*—Nils H. Ljungman & Associates

[57] ABSTRACT

An adjusting device for an electrode in a metal smelter. The device has a pressure mechanism comprising a, preferably, one-piece, ring-shaped flexible tube filled with a pressure medium. The pressure mechanism is positioned between clamp elements and radially positioned around the electrode and a frame. To ensure the secure retention of the electrode and increase the service life of the material of the pressurization tube, through a simple structural means, the present invention provides that the clamp elements have retaining brackets and guide brackets that are positioned to slide horizontally on the frame and support elements that are partially in contact with the tube that is filled with the pressure medium. The support elements are provided on the clamp elements.

20 Claims, 1 Drawing Sheet

20
21
22
41
25
24
31
32
30
20
42
33
41
21
24
23
40
10
43
2

APPARATUS FOR ADJUSTING THE POSITION OF AN ELECTRODE IN A METAL SMELTING FURNACE

CROSS REFERENCE TO RELATED APPLICATIONS

The subject matter in this application may relate to the subject matter in U.S. application Ser. No. 07/358,305 filed on May 26, 1989, entitled "Electrode Positioning Element".

BACKGROUND OF THE INVENTION

1. Field of the Invention

The present invention relates to an apparatus, for adjusting electrodes in a metal smelter. The apparatus includes a pressure mechanism comprising a, preferably, one-piece, ring-shaped flexible tube that is filled with a pressure medium. The pressure mechanism is positioned between clamp elements that are radially positioned around the electrode and a frame.

2. Background Information

German Patent No. 11 65 783 discloses an adjusting device wherein clamp elements are pressed against the external electrode shell by a pressure medium drive. An important element of the pressure medium drive is a one-piece, ring-shaped tube which can be filled with a pressure medium. An increase in the volume of the tube, caused by increasing pressure, provides the necessary contact pressure to fix, or hold, the electrode vertically and horizontally.

Since, in practice, the electrodes frequently have a weight of up to 50 metric tons (t), great forces are produced that must be compensated for by the pressure medium drive. The weight of the electrode generates high stresses. At the points where the pressurized tube is no longer pressed against the electrode by the radial contact pressure, high material strains are created in the tube, resulting from strong tensile stresses. In addition, the tube material can become even further stressed through deformation and compression at its corners.

OBJECT OF THE INVENTION

One objective of the invention is to provide an adjusting device that provides secure retention of the electrodes and increases the service life of the material of the pressurized tube through simple structural means.

SUMMARY OF THE INVENTION

That objective is met, according to the present invention, wherein clamp elements have retaining and guide brackets that are positioned to slide horizontally against the frame and wherein support elements, that are partially in contact with the tube filled with the pressure medium, are provided on the clamp elements.

In one embodiment of the present invention, the vertical forces of weight and the horizontal forces of contact pressure are accommodated separately. The stress component generated by the vertical forces of weight is transferred directly to the frame via the retaining bracket. The tube material is, therefore, then only subjected to the horizontal forces of contact pressure. The tube is adapted to accommodate the horizontal forces by dimensioning the ratio of the length and width of the tube so that they are in the range of about 5:1 to about 10:1. That ratio leads to a considerable relieving of the strains on the material of the pressurized tube.

The retaining bracket is employed to prevent uncontrolled downward sliding of the clamp elements when the pressure in the tube is reduced. The guide bracket, which does not have to transfer any forces, protects the pressure mechanism and provides for uniform contact pressure conditions.

The pressurized tube is surrounded by a frame that has curved projections and support elements. They permit expansion of the tube only in the direction of the electrode. Since the support elements are positioned to slide against, and in an overlapping manner, the projections, the shape of the tube is retained even under pressure during possible shifting of the clamp elements. Uncontrolled buckling of the tube is, thereby, prevented. The corner-free, curved shape of the support elements prevent contact of the pressurized tube with any sharp structural corners. The radii of the support elements and projections is adapted to the thickness of the tube. The tube material can be protected from fatigue and, also, from cracking by the above-recited configurations.

Also provided are parts, that may act as bearings, between the clamp elements and the electrode that wear out, or fail, before the remaining parts of the electrode positioning device wear out.

The advantage of providing such wear parts, between the clamp elements and the electrode, is that the surfaces directly in contact with the electrode can be replaced quickly and without problems. Their simple form contributes to reduced fabrication costs. Additionally, in the event that such wear parts fail, it is not necessary to replace the complete clamp element. The use of materials with slight thermal conductivity leads to attenuation of the heat between the electrode and the tube and, thus, reduces the heating of the tube material.

One aspect of the present invention resides broadly in an apparatus for adjusting the position of an electrode in a metal smelter comprising: clamp device for supporting the electrode; frame device positioned adjacent the clamp device; pressurization device supported by the frame device, the pressurization device having a surface positioned in abutting relation with the clamp device; support element device positioned in contact with the pressurization device and attached to the clamp device; device projecting from the frame device for slidably receiving the support element device for movement relative to the frame device; bracket device retained on the clamp device and slideable relative to the frame device, the bracket device for guiding movement of the clamp device relative to the frame device, and device for altering the pressure in the pressurization device to expand and contract the pressurization device to slide the support element device relative to the frame device and move the clamp device, thereby adjusting the position of the electrode relative to the frame device.

Another aspect of the invention resides broadly in an apparatus for adjusting an electrode comprising: a clamp for supporting the electrode; a frame positioned adjacent the clamp; a pressurization tube supported by the frame, said tube having a surface positioned in abutting relation with the clamp: a support element positioned in contact with the pressurization tube and attached to the clamp; device projecting from the frame for slidably receiving the support element for movement relative to the frame; bracket device retained on the clamp and slideable relative to the frame for guiding movement of the clamp relative to the frame, and device for altering the pressure in the tube to expand and contract the tube to slide said support element relative to the frame and move the clamp, thereby adjusting the position of the electrode relative to the frame.

BRIEF DESCRIPTION OF THE DRAWINGS

The following Description of the Preferred Embodiment may be better understood when taken in view of the appended drawing in which.

DESCRIPTION OF THE PREFERRED EMBODIMENT

Figure 1:
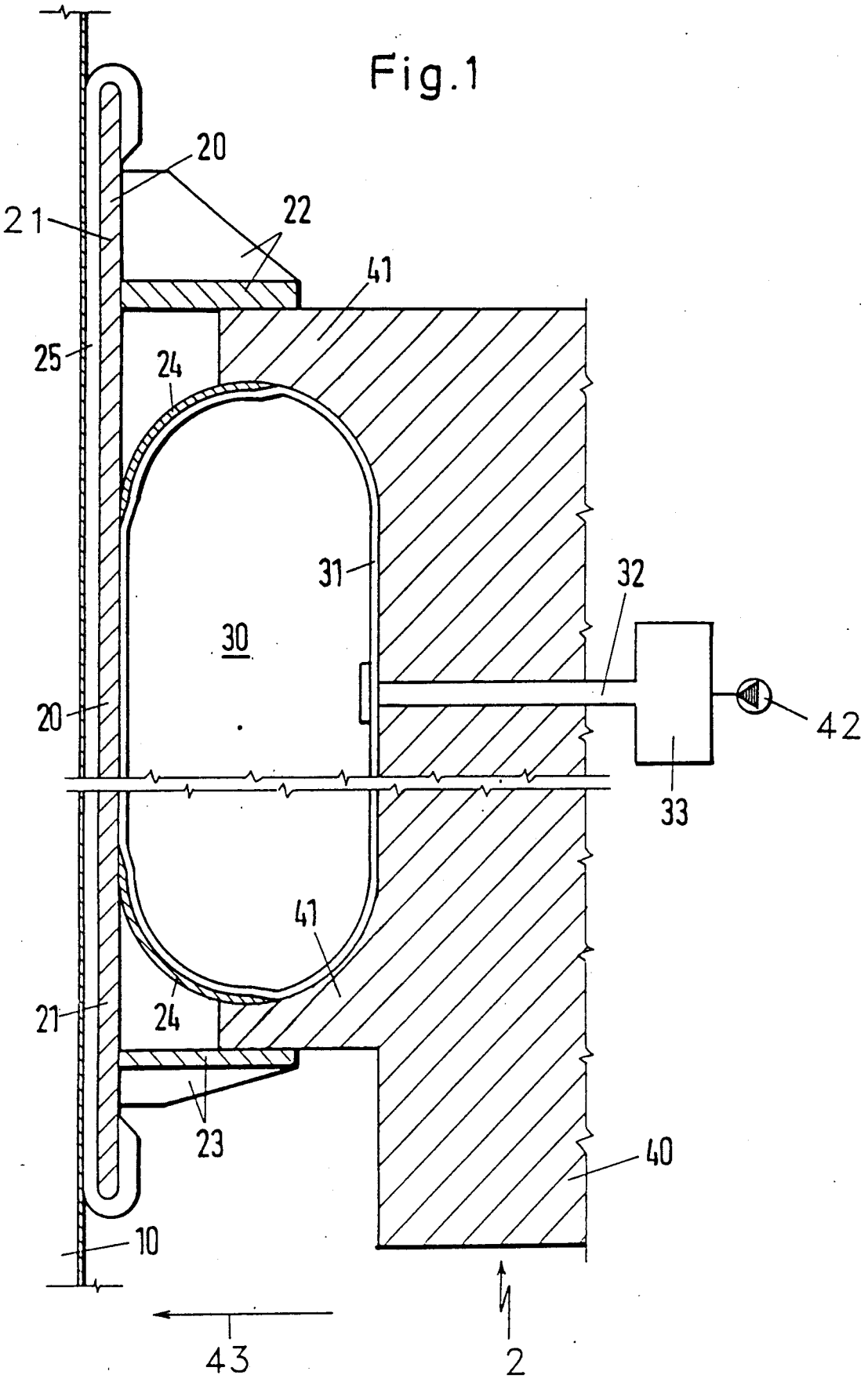
FIG. 1 shows the present invention in conjunction with an electrode and a pressure chamber.

FIG. 1 shows electrode adjusting device 2. Pressure mechanism 30 is positioned between clamp elements 20 and frame 40. Pressure mechanism 30, comprising pressurized tube 31, is supplied, from feed line 32, with a pressure medium by pressure generating station 33. Frame 40 has projections 41 that are curved inwardly on the side toward, and press against pressurized tube 31. Clamp element 20 is positioned radially around electrode 10 and includes segment 21 and attached part 25. It is intended that part 25 is a wear part that will wear out, or fail, before the other parts of device 2 wear out, or fail. Parts 25 may be ceramic. Segments 21 have retaining brackets 22 and guide brackets 23. Each, respective, retaining bracket 22 and guide bracket 23 is linked to a segment 21. The surfaces of brackets 22 lie against projections 41, of frame 40, and are positioned to slide horizontally. In addition, support elements 24 are installed on segment 21. Support elements 24 are curved metal sheets that come into contact with pressurized tube 31. Support elements 24 are positioned to slide against projections 41 in an overlapping manner. Support elements 24 are attached to segment 21 by a weld. Parts 25, which are intended to wear out or fail before the remainder of device 2, are positioned between electrode 10 and segments 21. They are applied in a form-fitting manner, to segments 21, with the ends of parts 25 bent around the edges of segments 21.

Pressure generating station 33 may be controlled by control 42. In operation, control 42 activates pressure generating station 33 to, thereby, initiate a flow of pressure medium through feed line 32 into pressurized tube 31. That, in turn, inflates pressurized tube 31 and causes it to expand in the direction of arrow 43. During this expansion, support elements 24 slide against projections 41. Also, retaining bracket 22 and guide bracket 23 slide, in the direction of arrow 43, on frame 40. Clamp element 20, which is partially in contact with pressurized tube 31, receives a force from the expanding pressurized tube 31 and, thus, moves in the direction of arrow 43. This force and motion is transmitted through part 25 which, in turn, moves the electrode in the direction of arrow 43.

Control 42 may also activate pressure generating station 33 to reduce the pressure in pressurized tube 31 by removing the pressure medium from pressurized tube 31 through feed line 32. In that case, pressurized tube 31 will deflate and contract in a direction opposite arrow 43. Thus, electrode 10 will, likewise, be moved in a direction opposite arrow 43.

In summary, one feature of the invention resides broadly in an adjusting device for electrodes with a pressure mechanism consisting of a one-piece, ring-shaped flexible tube 31 filled with a pressure medium, which is positioned between clamp elements positioned radially around the electrode and a frame, characterized in that the clamp elements (20) have retaining brackets (22) and guide brackets (23) positioned to slide horizontally against the frame (40), and in that support elements (24) are provided on the clamp elements (20) which are partially in contact with the tube (31) filled with the pressure medium.

Another feature of the invention resides broadly in the adjusting device for electrodes characterized in that the frame (40) has projections (41) curving inward on the side toward the tube in the region of the retaining brackets (22) and the guide brackets (23).

Yet another feature of the invention resides broadly in the adjusting device for electrodes characterized in that the support elements (24) are curved metal sheets.

A further feature of the invention resides broadly in the adjusting device for electrodes characterized in that the radius of the metal sheets (24) is at least five times the wall thickness of the tube (31).

A yet further feature of the invention resides broadly in the adjusting device for electrodes characterized in that the support elements (24) are positioned to slide against the projections (41) and overlap them.

Yet another further feature of the invention resides broadly in the adjusting device for electrodes characterized in that parts (25) intended to wear are provided between the clamp elements (20) and the electrode (10).

An additional feature of the invention resides broadly in the adjusting device for electrodes characterized in that the material of the parts (25) intended to wear has slight thermal conductivity, e.g., ceramic.

A yet additional feature of the invention resides broadly in the adjusting device for electrodes characterized in that the tube (31) has a dimension on its side parallel to the electrode (10) with a ratio of 5:1 to 10:1 to the dimension of the side of the tube perpendicular to the electrode (10).

One disclosure of an electrode positioning mechanism may be found in U.S. Patent Application Ser. No. 07/358,305, filed May 26, 1989, entitled "Electrode Positioning Device," for which a Notice of Allowability and a Notice of Allowance and Issue Fee Due were mailed on May 7, 1990.

Some examples of electrodes can be found in U.S. Pat. No. 4,495,624, entitled "Graphite Electrode Nipple"; U.S. Pat. No. 4,453,254, entitled "High Current Conduit System for Electrical Furnaces"; U.S. Pat. No. 4,168,156, entitled "Method of and Electric Furnace for Processing Nonferrous Molten Slags"; U.S. Pat. No. 4,617,672, entitled "Electric Furnace Arrangement"; U.S. Pat. No. 3,950,601, entitled "Electric Furnace" and U.S. Pat. No. 3,898,364, entitled "Combined Suspension Device for Holding, Contacting, Slipping and Torquing Electric Furnace Electrodes."

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Apparatus for adjusting the position of an electrode in a metal smelter, said apparatus comprising:
clamp means for supporting the electrode;
frame means positioned adjacent said clamp means;
pressurization means supported by said frame means;
said pressurization means having a surface positioned in abutting relation with said clamp means;
support element means positioned in contact with said pressurization means and attached to said clamp means;
means projecting from said frame means for slidably receiving said support element means for movement of said support element means relative to said frame means;
bracket means for guiding movement of said clamp means relative to said frame means;
said bracket means being retained on said clamp means;
said bracket means being slideable on said frame means;
said bracket means, said clamp means and said frame means each being configured and relatively positioned with one another to support substantially the entire vertical weight of the electrode such that said pressurization means is subjected to only substantially horizontal forces from the electrode; and
means for altering the pressure in said pressurization means to expand and contract said pressurization means to slide said support element means relative to said frame means and move said clamp means, thereby adjusting the position of the electrode relative to said frame means.

2. The apparatus of claim 1, wherein said frame means, said support element means and said clamp means are cooperatively configured to substantially surround said pressurization means to limit a direction of expansion of said pressurization means generally only toward the electrode when the pressure in said pressurization means is altered to expand said pressurization means.

3. The apparatus of claim 2, wherein said pressurization means defines a curved surface adjacent said support element means.

4. The apparatus of claim 3, wherein said support element is sheet metal means.

5. The apparatus of claim 4, wherein:
said support element means defines a radius;
said pressurization means comprises a wall;
said wall of said pressurization means defines a thickness; and
said radius of said support element means is at least five times greater than said thickness of said wall of said pressurization means.

6. The apparatus of claim 5, wherein said support element means is configured to overlap and slide over a curved surface of said pressurization means.

7. The apparatus of claim 6, further including wear part means positioned between the electrode and said clamp means, said wear part means for adjusting the position of the electrode relative to said frame means.

8. The apparatus of claim 7, wherein said wear part means is a heat conductive ceramic material.

9. The apparatus of claim 8, wherein:
said pressurization means defines a length and width; and
the ratio of said length to said width is in the range of 5:1 to 10:1.

10. The apparatus of claim 9, wherein said bracket means comprises at least a first portion and a second portion, both of said first portion and said second portion being movable on said frame means, said first portion and said second portion being spaced apart and said first portion and said second portion for being disposed on opposite sides of said pressurization means, said first portion being disposed to substantially support the entire vertical weight of the electrode and said second portion being disposed to substantially guide the sliding movement of said bracket means on said frame means.

11. Apparatus for adjusting an electrode, said apparatus comprising:
a clamp for supporting the electrode;
a frame positioned adjacent said clamp;
a pressurization tube supported by said frame;
said pressurization tube having a surface positioned in abutting relation with said clamp;
a support element positioned in contact with said pressurization tube;
said support element being attached to said clamp;
means projecting from said frame for movably receiving said support element for movement of said support element relative to said frame;
bracket means for guiding movement of said clamp relative to said frame;
said bracket means being retained on said clamp;
said bracket means being movable on said frame;
said clamp, said frame and said bracket means each being configured and relatively positioned with one another to support substantially the entire vertical weight of the electrode such that said pressurization tube is subjected to only substantially horizontal forces from the electrode; and
means for altering the pressure in said pressurization tube to expand and contract said pressurization tube to move said support element relative to said frame and move said clamp, thereby adjusting the position of the electrode relative to said frame.

12. The apparatus of claim 11, wherein said frame, said support element and said clamp are cooperatively configured to substantially surround said pressurization tube to limit the direction of expansion of said pressurization tube generally only toward the electrode when the pressure in said pressurization tube is altered to expand said pressurization tube.

13. The apparatus of claim 12, wherein said pressurization tube defines a curved surface adjacent said support element.

14. The apparatus of claim 13, wherein said support element is sheet metal means.

15. The apparatus of claim 14, wherein:
said support element defines a radius:
said pressurization tube comprises a wall;
said wall of said pressurization tube defines a thickness; and
said radius of said support element is at least five times greater than said thickness of said wall of said pressurization tube.

16. The apparatus of claim 15, wherein said support element is configured to overlap and slide over said curved surface of said pressurization tube.

17. The apparatus of claim 16, further including wear part means positioned between the electrode and said clamp, said wear part means for adjusting the position of the electrode relative to the frame.

18. The apparatus of claim 17, wherein said wear part means is a heat conductive ceramic material.

19. The apparatus of claim 18, wherein:

said pressurization tube defines a length and a width; and the ratio of said length to said width is in the range of 5:1 to 10:1.

20. The apparatus of claim 19, wherein said bracket means comprises at least a first portion and a second portion, both of said first portion and said second portion being movable on said frame means, said first portion and said second portion being spaced apart and said first portion and said second portion for being disposed on opposite sides of said pressurization means, said first portion being disposed to substantially support the entire vertical weight of the electrode and said second portion being disposed to substantially guide the sliding movement of said bracket means on said frame means.

* * * * *